United States Patent [19]

Tate

[11] 4,229,870

[45] Oct. 28, 1980

[54] FREEZE PLUG INSTALLATION KIT

[76] Inventor: Ernest L. Tate, 9268 San Diego St., Spring Valley, Calif. 92077

[21] Appl. No.: 966,894

[22] Filed: Dec. 6, 1978

[51] Int. Cl.[3] ..... B23P 19/04

[52] U.S. Cl. ..... 29/254; 29/275

[58] Field of Search ..... 29/254, 255, 275; 81/52.35

[56] References Cited

U.S. PATENT DOCUMENTS

| | | | |
|---|---|---|---|
| 1,333,881 | 3/1920 | Stine | 29/275 |
| 1,958,329 | 5/1934 | Beard | 29/254 |
| 3,064,342 | 11/1962 | Wagoner | 29/275 |
| 3,710,655 | 1/1973 | Brandle | 81/52.35 |

*Primary Examiner*—James L. Jones, Jr.

*Attorney, Agent, or Firm*—Ralph S. Branscomb

[57] ABSTRACT

A freeze plug installation tool adapted to be driven by a pneumatic driver is provided, preferably in kit form having a driver section which chucks into a pneumatic driver, one or several extensions shafts connectable to the driving section, and several freeze plug carrying heads which carry freeze plugs at various angles, so that by utilizing the kit in its various permutations numerous different combinations are provided which accomodate varying freeze plug installation situations involving hard to reach installation points.

1 Claim, 15 Drawing Figures

FIG. 1
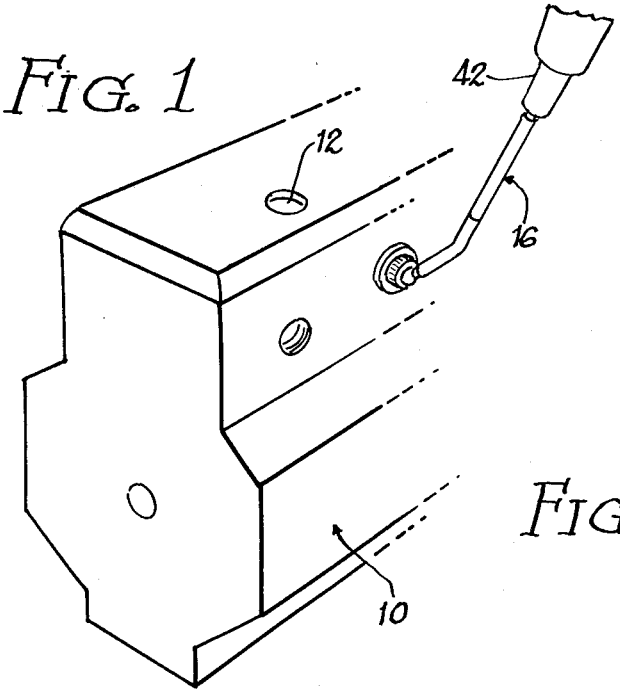
FIG. 1a
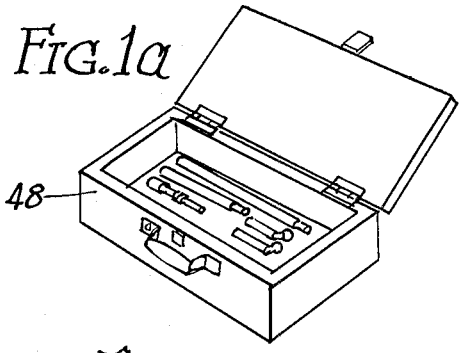
FIG. 2
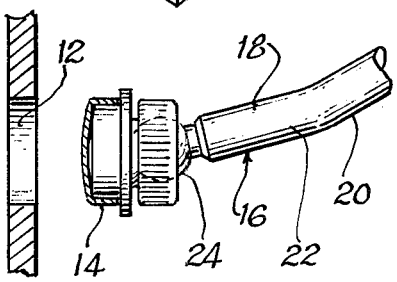
FIG. 4
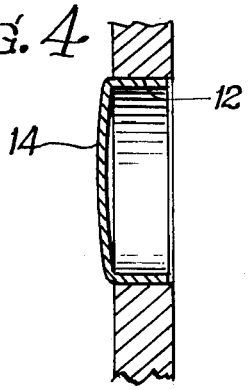
FIG. 3
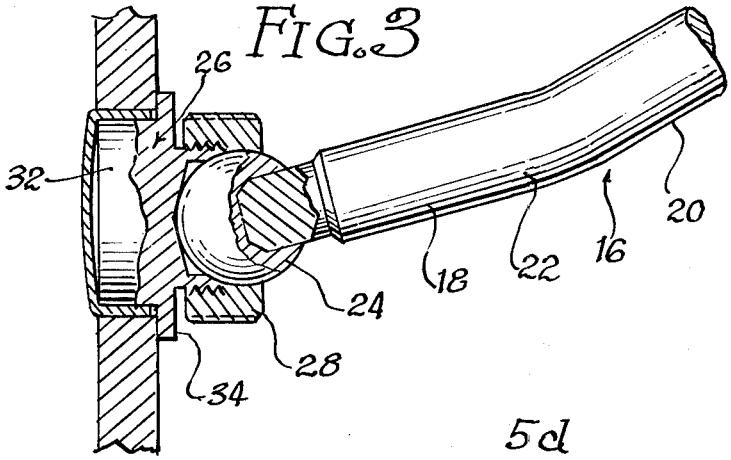
FIGS.
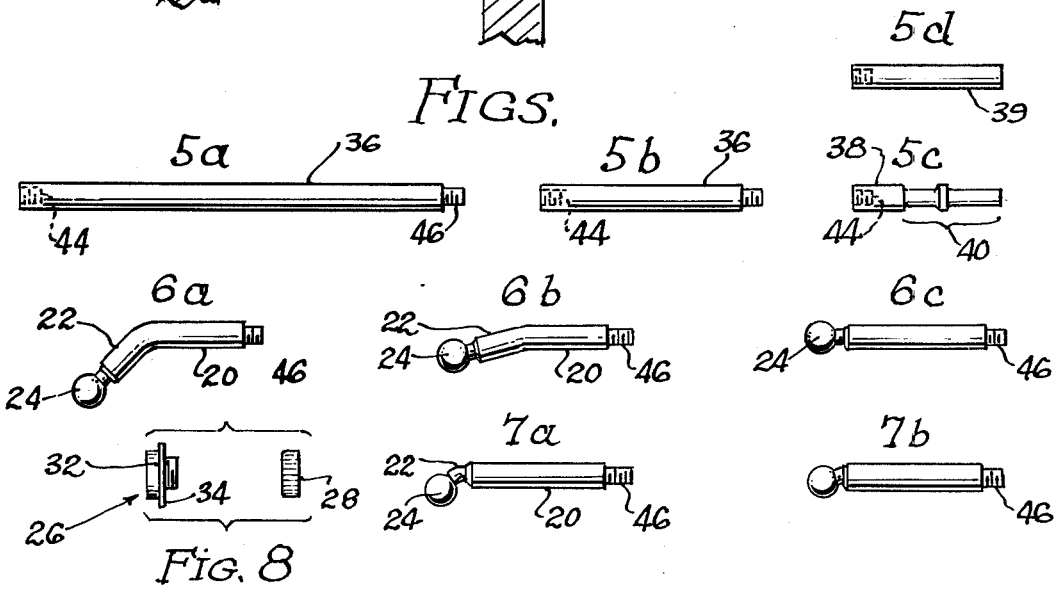
FIG. 8

FREEZE PLUG INSTALLATION KIT

BACKGROUND OF THE INVENTION

All water cooled automobile engines are provided with expansion holes in the water jacket which are plugged with freeze plugs which theoretically, if not in practice, pop out upon the accidental freezing of the water in the water jacket to preserve the water jacket itself. Over a period of time, these freeze plugs become rusty and weak and must be knocked out and replaced. Different techniques are available for knocking the plugs out, and as considerable force and impact is required to drive the plugs into place, tools adapted to this purpose have been developed.

Typically, these tools include a head on the end of a bent rod which is manually pounded with a hammer or mallet on its free end. This approach to the problem is imperfect in that to orient the tool with one hand and swing a hammer with the other often is quite awkward and not infrequently will require two people to do the-job rather than a single mechanic which would otherwise be required. This difficulty is caused by the very close spaces and often awkwardly oriented freeze plug holes which the automotive mechanic faces when trying to reinstall the plugs.

SUMMARY OF THE INVENTION

The present invention is an improvement over the relatively primitively tools of the prior art and constitutes a set of individual tool sections assemblable into a variety of different configuations which provide a tool of various lengths and having variously oriented freeze plug carrying heads, and all of the tools which are capable of being assembled from the kit having a pneumatic driver received segment so that an air gun may be used alternatively to the hammer, permitting the tool and air gun together to be operated by a single hand, freeing the mechanic's other hand to support himself or guide the tool and freeze plug into place.

BRIEF DESCRIPTION OF THE DRAWINGS

FIG. 1 is a diagrammatic view of an engine block showing the tool in use;

FIG. 1*a* is a perspective view of the kit in a case;

FIG. 2 is a view of a segment of the engine block water jacket showing the installation of a freeze plug by means of the instant tool;

FIG. 3 shows the freeze plug pressed into place by means of the tool, which is shown partially cut away;

FIG. 4 shows a segment of the water jacket having the freeze plug inserted;

FIGS. 5*a* and 5*b* illustrate two different lengths of the shaft section;

FIGS. 5*c* and 5*d* are elevational views of the driver section adapted for use with an air gun and hammer respectively.

FIGS. 6*a*, 6*b* and 6*c* illustrate the head section of the tool adapted to carry the freeze plug carrier in three different orientations;

FIGS. 7*a* and 7*b* show modified means of achieving the different freeze plug carrier orientations achieved by the head sections of FIGS. 6*a* and 6*b*, respectively; and FIG. 8 is an elevation view of the freeze plug carrier and retaining gland nut.

DETAILED DESCRIPTION OF THE PREFERRED EMBODIMENT

An engine block is very diagrammatically shown at 10 in FIG. 1, therebeing several freeze plug holes 12 at various positions in the casing 10. These holes are of course ordinarily filled with freeze plugs such as plug 14 best seen in FIG. 4. However, when the old plugs have rusted and have been knocked out, the new plugs are inserted by means of the freeze plug installation tool 16 which is the subject of this patent. The operative portion of the tool is the head end 18 shown in operation in FIGS. 2 and 3. The head end constitutes a shank portion 20 and a freeze plug carrier mounting section 22, the latter of which has a ball 24 mounted to the end.

Connected to this ball is a freeze plug carrier 26 which defines a socket together with gland nut 28 so that the freeze plug carrier and gland nut together ride on the ball 24.

The freeze plug carrier 26 ordinarily will have a centering boss 32 with a peripheral shoulder 34 which drives the freeze plug into place when it receives an impact. The shoulder 34 prevents the plug from being driven into the water jacket.

FIGS. 4*a* and 4*b* illustrate two various lengths of extension shafts 36 which define the central sections of the tool. The driver section 38 as shown in FIG. 4*c* has an adapter end 40 which is received in the chuck of a pneumatic gun 42, shown in FIG. 1. As can be seen in FIGS. 4*a* through 4*c*, each of these segments has a threaded bore 44 and a threaded shaft 42. Each of the head sections 18, shown in their different embodiments in FIGS. 5*a* through 6*b*, also have a threaded shaft 42 so that the driving section 38 of FIG. 4*c* can be screwed onto either or both of the extension shafts 36 which are then screwed onto one of the head sections 18, or the driver section 38 can be screwed directly onto the head section if no extension is required. Thus with just the two extensions 4*a* and 4*b*, four possible lengths of the tool are capable of being produced by different combinations of the parts.

In order to properly position the freeze plug for installation in many engines because of obstacles and narrow working space, it is frequently desired that a freeze plug be carried at an angle to the main shaft of the tool. For this reason, the freeze plug carrier mounting portion 22 of the head section 18 of the tool intersects the shank portion 20 at different angles. In the embodiment of FIG. 5*a* this angle is about 45°, in 5*b* perhaps 20°, and 5*c* is 0°, representing a simple straight shaft. The same effect is demonstrated in FIGS. 6*a* and 6*b*, wherein the 45° and 20° orientation of the carrier mounting ball 24 is achieved by a simple bend in the metal adjacent the ball which defines a shortened portion 22 compared to that represented in FIGS. 5*a* through 5*c*. Thus in addition to different lengths of connector shaft versatility of the tool is achieved by providing different head mounts.

FIG. 7 illustrates the freeze plug carrier 26 and its gland nut 28 as exploded and separated from the ball on which it is ordinarily mounted. Because the carrier is so simply removable from the ball, it may be one of a set of several such carriers to accomodate freeze plug of varying sizes, of which there are at least 6.

Because the kit form of presentation, shown at 48 in FIG. 1*a* permits assembly of a very short tool, and the air gun adds only about six more inches to the overall length, freeze plugs can be installed in spaces too small to otherwise permit installation because the space needed to adequately swing a hammer is much more than six inches.

Another advantage of using an air gun is the increased safety which is achieved by the elimination of the need to swing a hammer against a shaft, often at an unwieldy angle. Despite these advantages which will generally prevail with the use of an air gun, from time to time a hammer may be preferred. To accomodate a hammer without risking damage to the air gun driver section 38, an alternative mallet-driven section 39 can be included in the kit 48.

Thus the instrument which is the subject of this description and the appended claims represents the ultimate in versatility and utility in the installation of freeze plugs, making it possible for a single operator to install freeze plugs in virtually any car in a small portion of the time otherwise used in the use of conventional installation tools.

I claim:

1. A freeze plug installation tool kit comprising:

(a) a plurality of selectable head sections each having one end defining a ball which selectably swivel mounts a releasible freeze plug carrier and another end which is a connector end there being a shank between said connector end and said ball-defining end and the shank of each of said head sections having a bend defining a different angle than the shank of every other of said head sections;

(b) a driver section having one end adapted to chuck into a pneumatic driver and another end which is a connector end;

(c) a set of extension shaft sections of different lengths, each having two ends, both of which are connector ends adapted to releasibly connect to the connector ends of said driver section and any selected one of head sections to define one of numerous selectable single integral units when said selected head, shaft, and driver sections are connected together.

* * * * *